US006752041B2

(12) United States Patent
Lee

(10) Patent No.: US 6,752,041 B2
(45) Date of Patent: Jun. 22, 2004

(54) ELECTRIC CORKSCREW

(75) Inventor: Ming-Hsiang Lee, Tainan (TW)

(73) Assignee: Taiwan Wan Nien Electric Appliance Co., Ltd., Tainan Hsien (TW)

( * ) Notice: Subject to any disclaimer, the term of this patent is extended or adjusted under 35 U.S.C. 154(b) by 0 days.

(21) Appl. No.: 10/351,783

(22) Filed: Jan. 27, 2003

(65) Prior Publication Data

US 2003/0230172 A1 Dec. 18, 2003

(30) Foreign Application Priority Data

Jun. 17, 2002 (TW) ..... 91209032 U

(51) Int. Cl.[7] ..... B67B 7/04
(52) U.S. Cl. ..... 81/3.2; 81/3.45
(58) Field of Search ..... 81/3.2, 3.29, 3.45, 81/3.08

(56) References Cited

U.S. PATENT DOCUMENTS 4,955,261 A * 9/1990 Chiang ..... 81/3.2
5,079,975 A * 1/1992 Spencer, Jr. ..... 81/3.2
5,095,778 A * 3/1992 Bocsi et al. ..... 81/3.2
5,351,579 A * 10/1994 Metz et al. ..... 81/3.2
5,503,047 A * 4/1996 Brockington ..... 81/3.2
5,724,869 A * 3/1998 May ..... 81/3.2
2002/0178867 A1 * 12/2002 Lun ..... 81/3.2
2003/0029276 A1 * 2/2003 Falcone ..... 81/3.2

* cited by examiner

*Primary Examiner*—D. S. Meislin
(74) *Attorney, Agent, or Firm*—Whyte Hirschboeck Dudek SC

(57) ABSTRACT

In an electric corkscrew, a power switch controls supply of electric power from an electric power source to a motor unit so as to drive an auger to rotate in a positive direction for screwing into a cork that is to be unplugged from a bottleneck or a negative direction for screwing out of the cork that was unplugged from the bottleneck. A control switch interrupts electrical connection between the electric power source and the motor unit when actuated by the cork in a cork passage defined by a sleeve body in a grip member while the cork extends out of the cork passage as a result of rotation of the auger in the positive direction.

8 Claims, 12 Drawing Sheets

ELECTRIC CORKSCREW

CROSS-REFERENCE TO RELATED APPLICATION

This application claims priority of Taiwanese Application No. 091209032, filed on Jun. 17, 2002.

BACKGROUND OF THE INVENTION

1. Field of the Invention

The invention relates to an electric corkscrew, more particularly to an electric corkscrew that can be operated between cork-screwing and cork-releasing modes by controlling rotation of a motor unit in positive and negative directions.

2. Description of the Related Art

Electric corkscrews, such as that disclosed in U.S. Pat. No. 6,101,899, are known in the art. However, in the conventional electric corkscrew, no means is provided to turn off the same automatically when a cork has been unplugged from a bottleneck.

SUMMARY OF THE INVENTION

Therefore, the object of the present invention is to provide an electric corkscrew that can automatically shut down when a cork in a bottleneck has been screwed out of the bottleneck.

According to the present invention, an electric corkscrew comprises:

a hollow grip member having an open lower end that is adapted to permit extension of a bottleneck plugged with a cork into the grip member;

an electric power source mounted in the grip member;

a motor unit mounted in the grip member;

an auger disposed rotatably in the grip member, coupled to the motor unit, extending to the lower end of the grip member, and adapted to screw into the cork in the bottleneck;

a power switch including first and second stationary contact members mounted fixedly in the grip member and coupled electrically to the motor unit, and a movable contact member mounted movably in the grip member and coupled electrically to the electric power source, the movable contact member being movable among one of a motor-deactivating position, a cork-screwing position and a cork-releasing position, wherein, when the movable contact member is disposed in the motor-deactivating position, the movable contact member does not contact any one of the first and second stationary contact members such that the motor unit is disconnected from the electric power source and does not drive rotation of the auger in the grip member, wherein, when the movable contact member is disposed in the cork-screwing position, the movable contact member contacts the first stationary contact member to enable supply of electric power from the electric power source to the motor unit with a forward polarization such that the motor unit drives the auger to rotate in a positive direction for screwing into the cork that is to be unplugged, and wherein, when the movable contact member is disposed in the cork-releasing position, the movable contact member contacts the second stationary contact member to enable supply of electric power from the electric power source to the motor unit with a reverse polarization such that the motor unit drives the auger to rotate in a negative direction for screwing out of the cork that was unplugged from the bottleneck; and a control unit including a sleeve body disposed in the grip member adjacent to the lower end, the sleeve body defining a cork passage with a wider lower portion, a narrower upper portion, and an intermediate shoulder portion between the lower and upper portions, the auger extending through the upper portion and into the lower portion of the cork passage, the lower portion being adapted to permit extension of the bottleneck therein, the shoulder portion being adapted to stop the bottleneck from extending into the upper portion, the upper portion being formed with rib means for engaging the cork on the auger to resist rotation of the cork with the auger when the cork extends into the upper portion of the cork passage, and a normally closed control switch disposed in the grip member above the sleeve body and interconnecting electrically the first stationary contact member and the motor unit, the control switch being adapted to be actuated by the cork in the cork passage when the cork extends out of the upper portion of the cork passage as a result of rotation of the auger in the positive direction, the control switch interrupting electrical connection between the first stationary contact member and the motor unit when actuated by the cork so as to disconnect the motor unit from the electric power source and cease further rotation of the auger in the positive direction.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
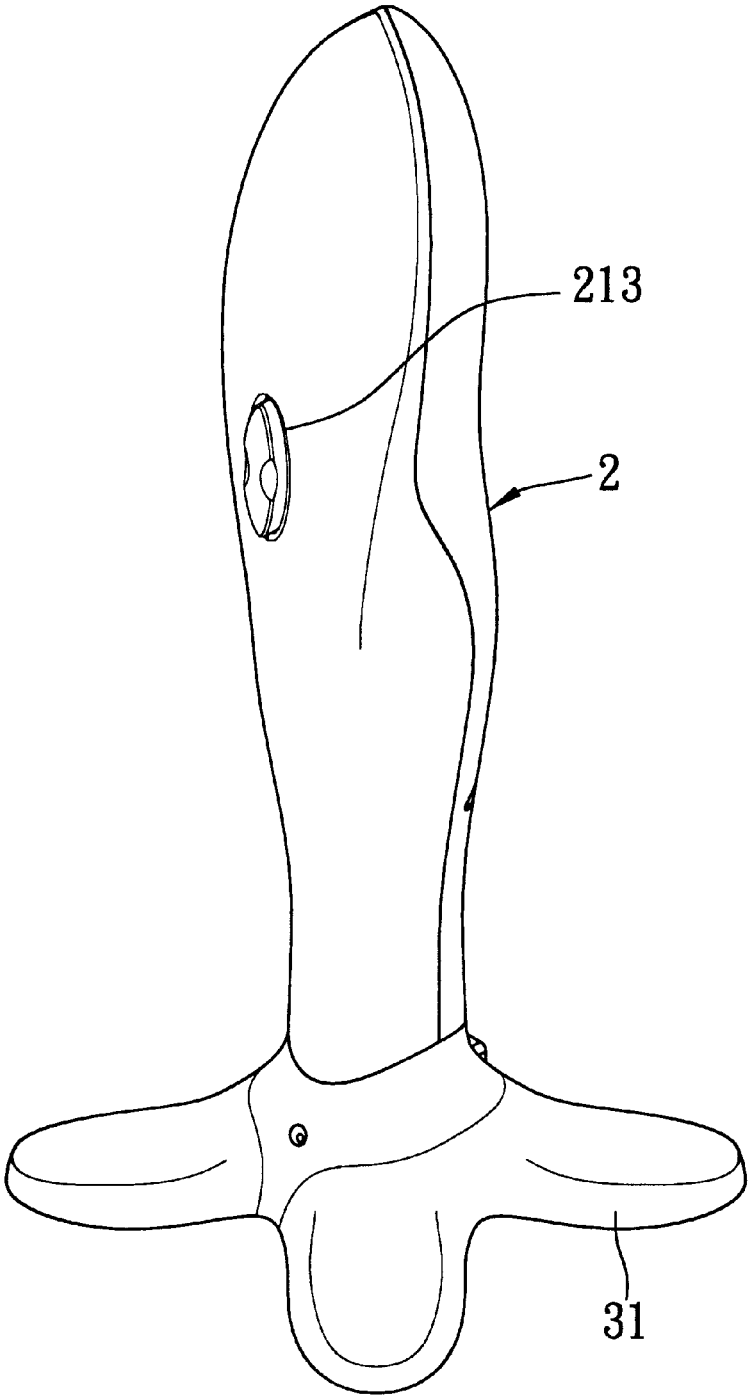
FIG. 1 is a perspective view showing the preferred embodiment of an electric corkscrew according to this invention.
Figure 2:
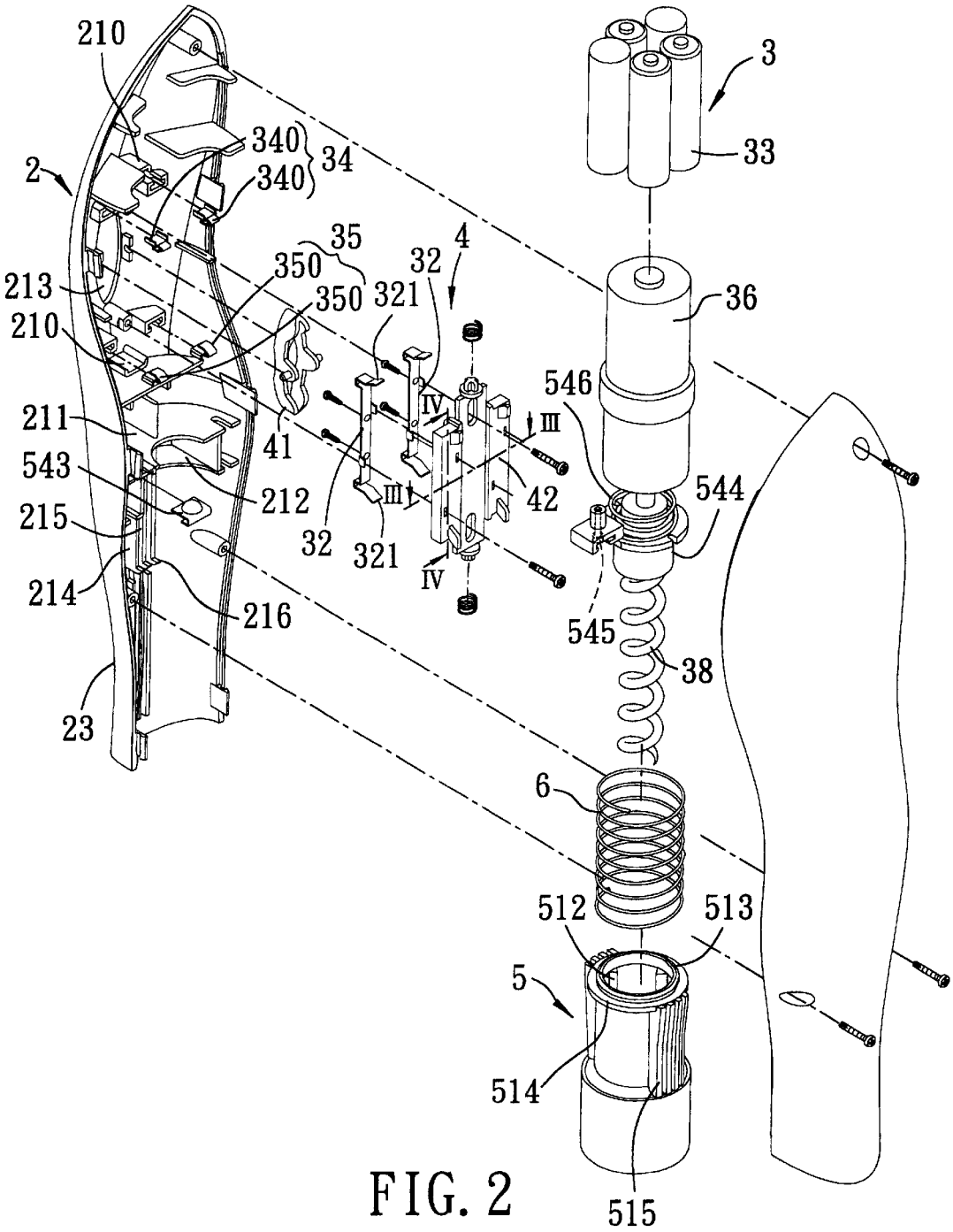
FIG. 2 is an exploded perspective view showing the preferred embodiment.
Figure 5:
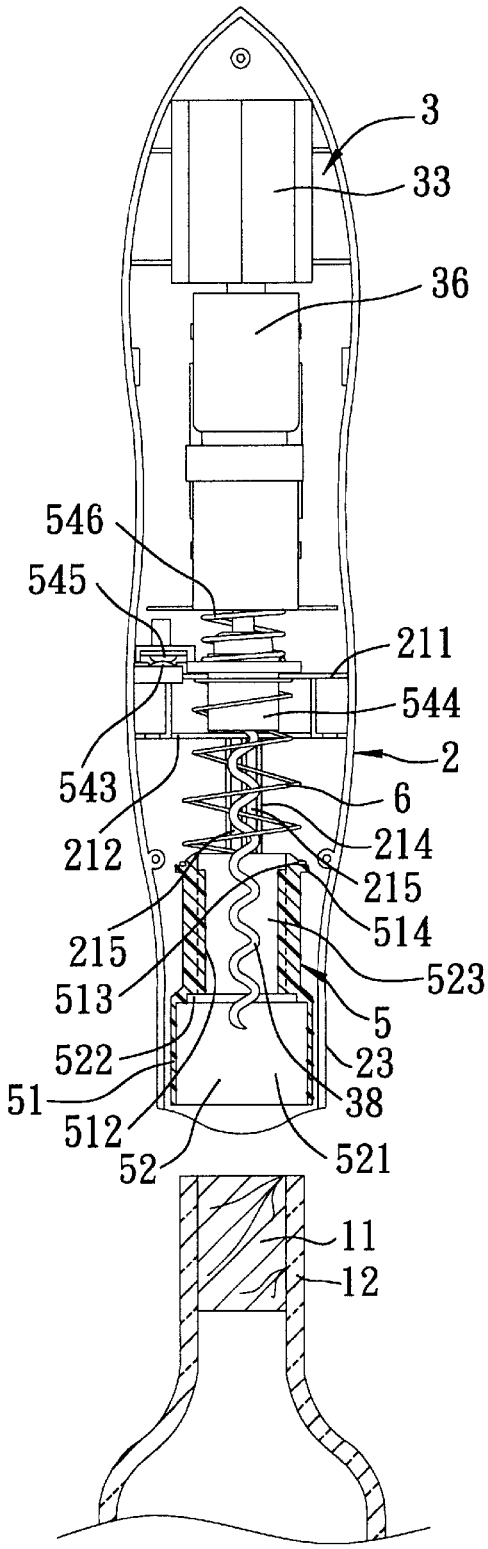
FIG. 5 is a schematic sectional view of the preferred embodiment.

Referring to FIGS. 1, 2 and 5, the preferred embodiment of an electric corkscrew according to the present invention is shown to include a hollow grip member 2, an electric power source 3, a motor unit 36, an auger 38, a power switch, and a control unit.

The grip member 2 includes complementary casing parts, and has an open lower end 23 that is adapted to permit extension of a bottleneck 12 plugged with a cork 11 into the grip member 2 (see FIG. 5). The grip member 2 is formed with upper and lower stop units 212, 216, and a switch-mounting hole 213. The upper stop unit 212 is formed as a stop ring mounted on an inner surface of the grip member 2. The lower stop unit 216 is formed as a plurality of stubs.

The electric power source 3 is mounted in the grip member 2 (see FIG. 2). In this embodiment, the electric power source 3 includes a rechargeable battery set 33, and a charging seat 31 (see FIG. 1) for charging the battery set 33 in a conventional manner.

The motor unit 36 is a known bi-directional motor mounted in the grip member 2.

The auger 38 is disposed rotatably in the grip member 2, is coupled to the motor unit 36, extends to the lower end 23 of the grip member 2, and is adapted to screw into the cork 11 in the bottleneck 12.

Figure 3:
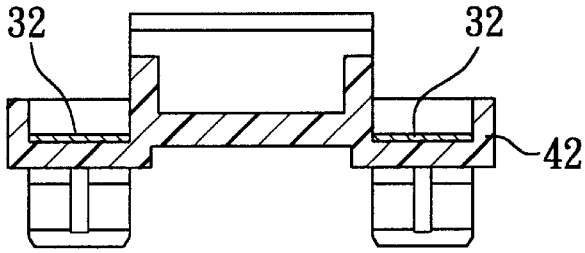
FIG. 3 is a schematic sectional view of FIG. 2 taken along line III—III.
Figure 4:
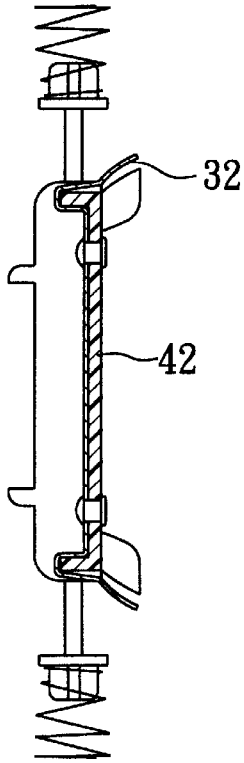
FIG. 4 is a schematic sectional view of FIG. 2 taken along line IV—IV.
Figure 6:
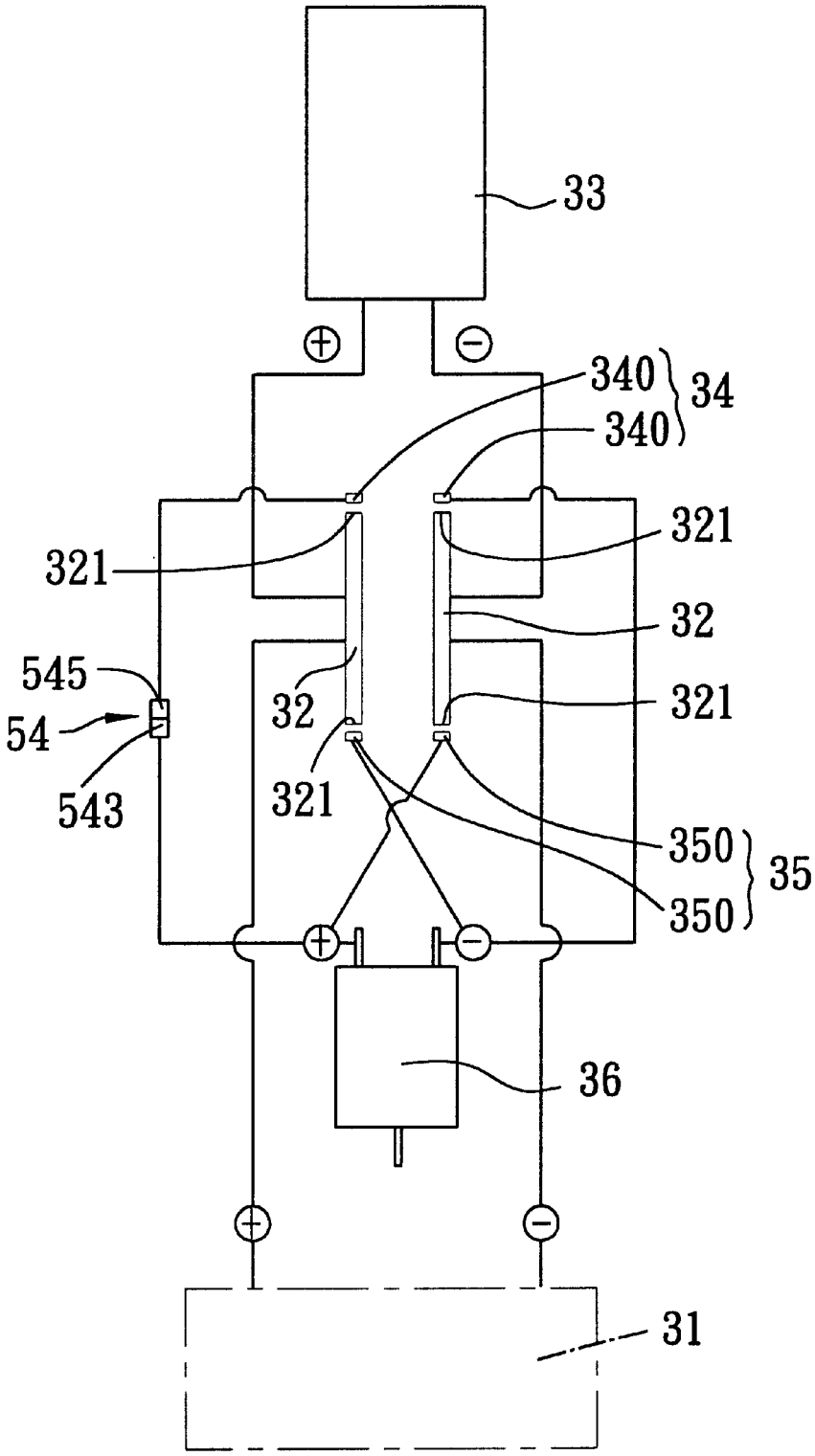
FIG. 6 is a schematic electrical circuit diagram of the preferred embodiment.
Figure 7:
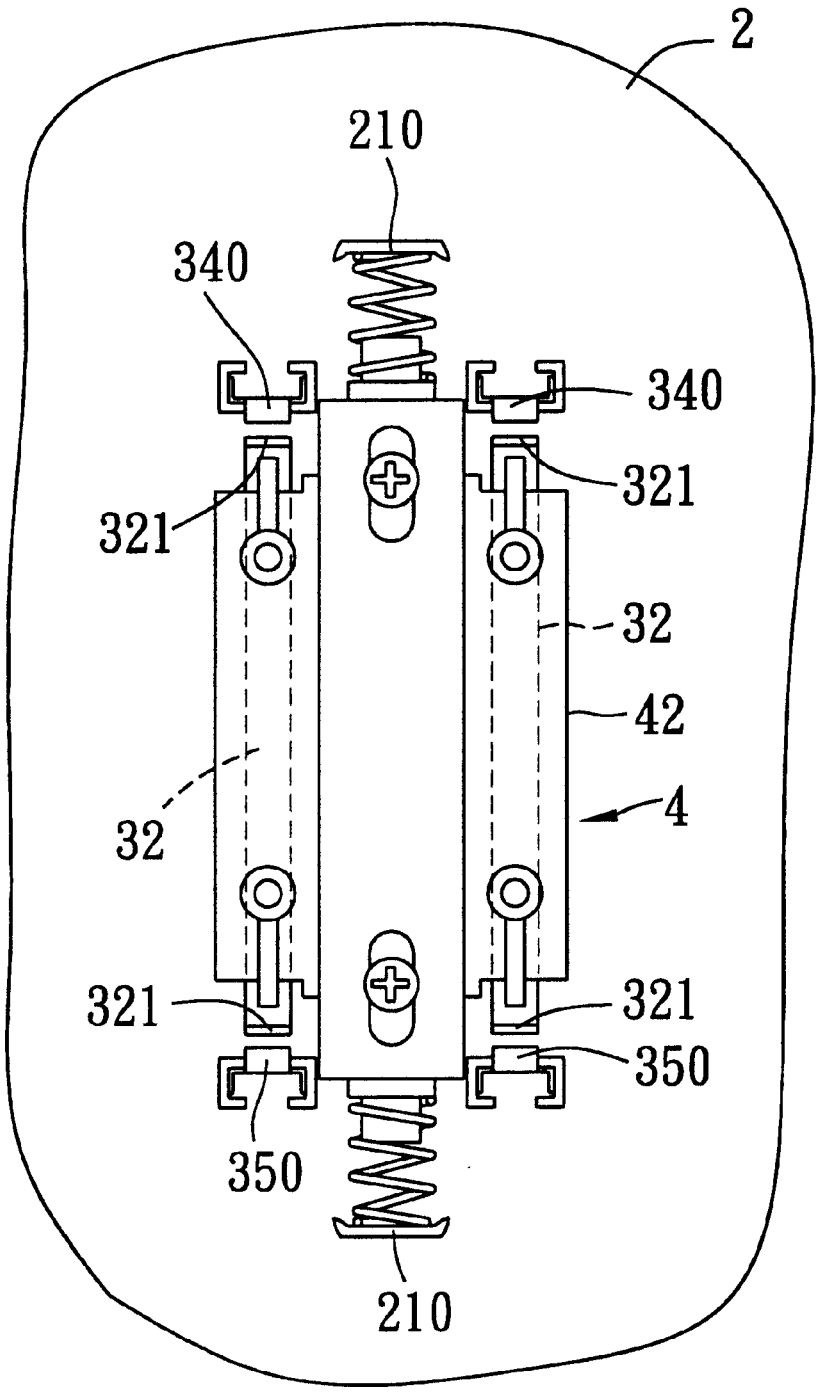
FIG. 7 is a schematic side view showing a power switch of the preferred embodiment.

The power switch includes first and second stationary contact members 34, 35, and a movable contact member 4 mounted movably in the grip member 2. In this embodiment, each of the first and second stationary contact members 34, 35 includes a pair of contacts 340, 350 mounted fixedly in the grip member 2, as shown in FIG. 2, and coupled electrically to the motor unit 36, as best shown in FIG. 6. With further reference to FIG. 7, the movable contact member 4 includes a spring-loaded slide frame 42 mounted movably in the grip member 2 and disposed between opposite abutting pieces 210, which are formed on the inner surface of the grip member 2, and a pair of conductive plates 32 mounted on the slide frame 42, as best shown in FIGS. 3 and 4, and coupled electrically to the battery set 33 and to the charging seat 31 (see FIG. 6). Each of the conductive plates 32 has a pair of contact ends 321. Each of the contact ends 321 of each of the conductive plates 32 is disposed adjacent to a respective one of the contacts 340, 350 of the first and second stationary contact members 34, 35, as best shown in FIG. 7. The movable contact member 4 is movable among one of a motor-deactivation position, a cork-screwing position and a cork-releasing position.

When the movable contact member 4 is disposed in the motor-deactivating position, the conductive plates 32 of the movable contact member 4 do not contact any one of the contacts 340, 350 of the first and second stationary contact members 34, 35 such that the motor unit 36 is disconnected from the electrical power source 3 (i.e., the battery set 33 and the charging seat 31) and does not drive rotation of the auger 38 in the grip member 2, as shown in FIG. 6.

Figure 10:
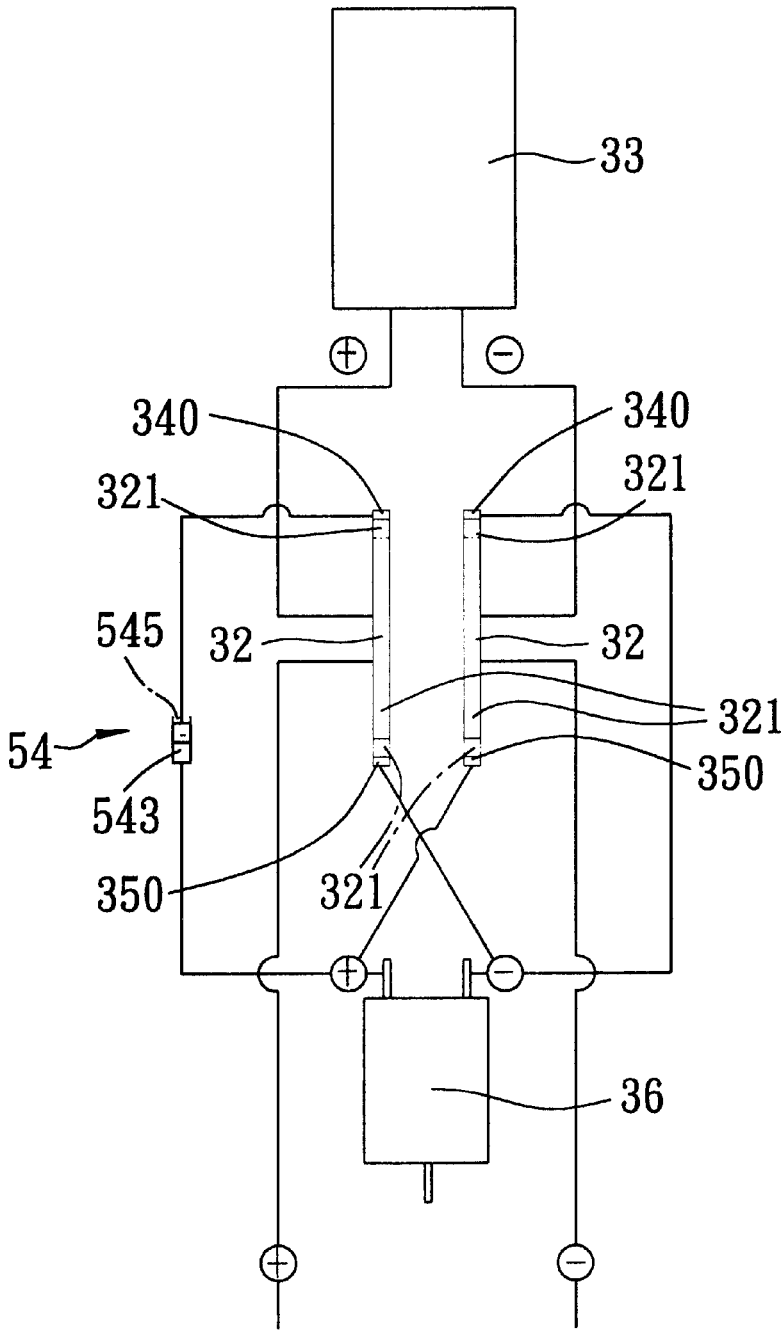
FIG. 10 is a schematic electrical circuit diagram illustrating the preferred embodiment when the power switch is in the cork-screwing mode.
Figure 11:
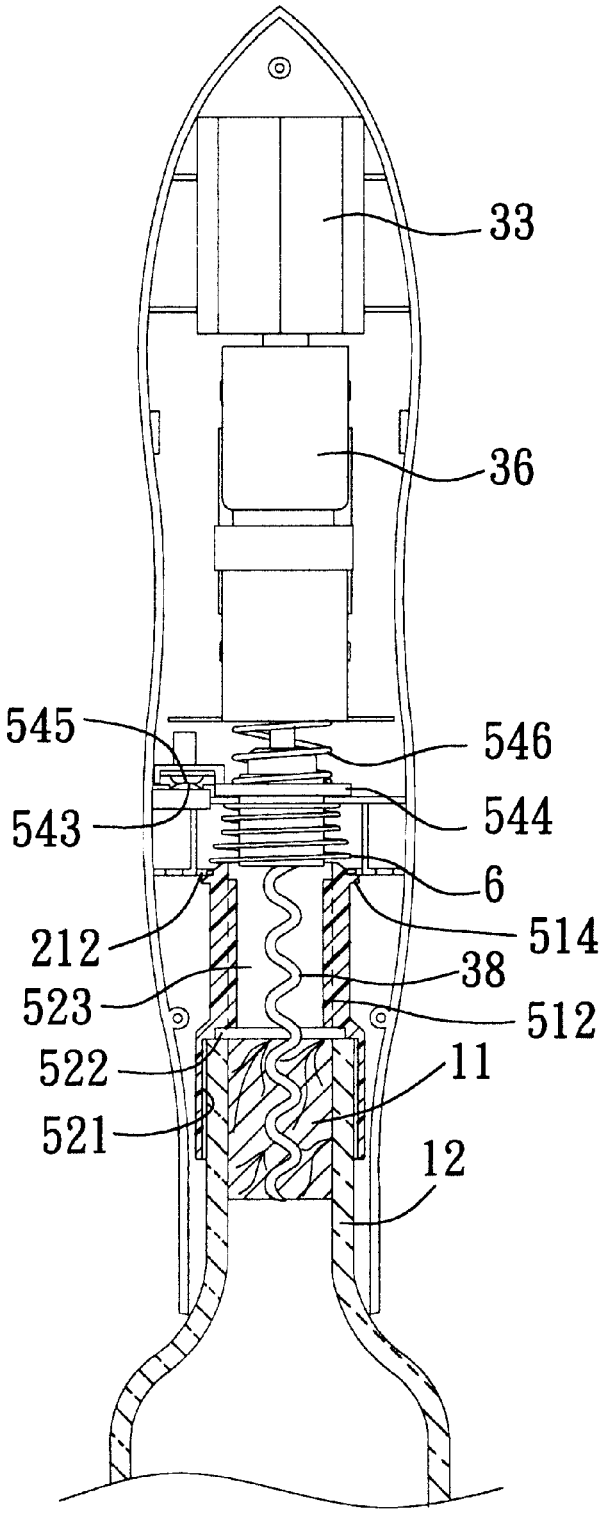
FIG. 11 is a schematic sectional view showing the preferred embodiment when an auger screws into a cork in a bottleneck.

When the movable contact member 4 is disposed in the cork-screwing position, the contact ends 321 of the conductive plates 32 of the movable contact member 4 contact respectively the contacts 340 of the first stationary contact member 34, as shown by the solid lines in FIG. 10, to enable supply of electric power from the battery set 33 of the electric power source 3 to the motor unit 36 with a forward polarization such that the motor unit 36 drives the auger 38 to rotate in a positive direction for screwing into the cork 11 that is to be unplugged (see FIG. 11).

When the movable contact member 4 is disposed in the cork-releasing position, the contact ends 321 of the conductive plates 32 of the movable contact member 4 contact respectively the contacts 350 of the second stationary contact member 35, as indicated by the imaginary lines in FIG. 10, to enable supply of electric power from the battery set 33 of the electric power source 3 to the motor unit 36 with a reverse polarization such that the motor unit 36 drives the auger 38 to rotate in a negative direction for screwing out of the cork 11 that was unplugged from the bottleneck 12.

Figure 8:
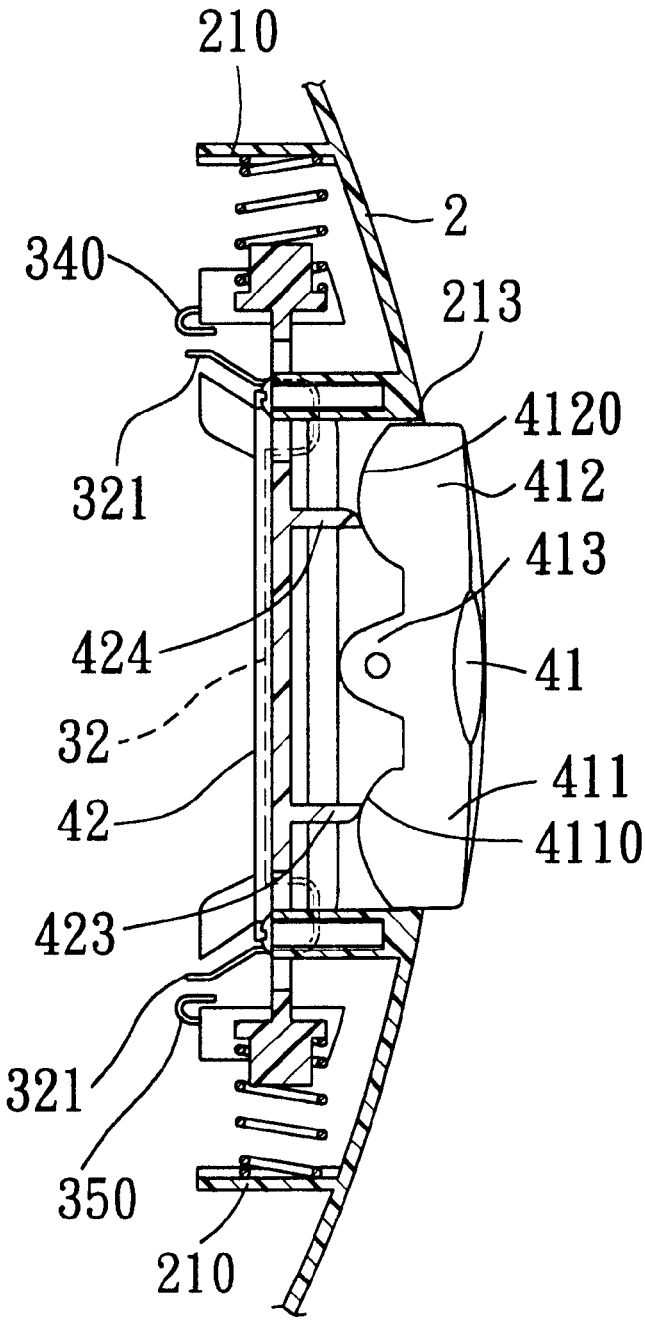
FIG. 8 is a fragmentary schematic sectional view illustrating the power switch in a motor-deactivating mode.
Figure 9B:
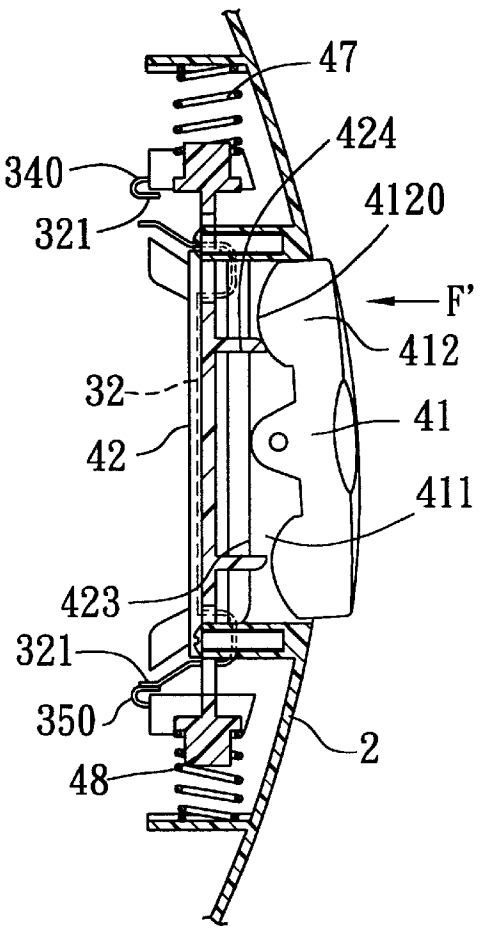
FIG. 9B is a fragmentary schematic sectional view illustrating the power switch in a cork-releasing mode.
Figure 9A:
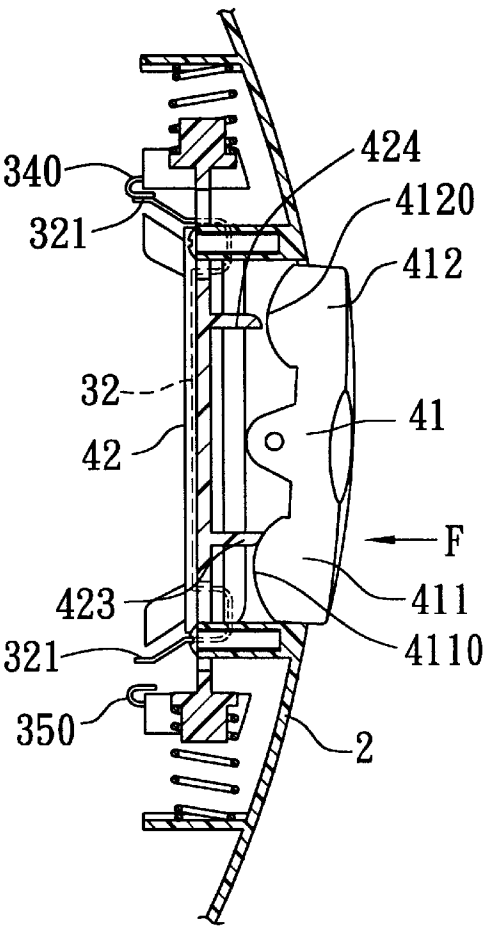
FIG. 9A is a fragmentary schematic sectional view illustrating the power switch in a cork-screwing mode.

The power switch further includes a switch actuator 41 mounted on the grip member 2 in the switch-mounting hole 213. As shown in FIG. 8, the switch actuator 41 has upper and lower end portions 412, 411, and an intermediate portion 413 connected to the upper and lower end portions 412, 411 and pivotally connected to the grip member 2. Each of the upper and lower end portions 412, 411 is formed with a drive projection 4120, 4110. The slide frame 42 is formed with first and second driven projections 423, 424, each of which is to be driven by the drive projection 4110, 4120 on a respective one of the lower and upper end portions 411, 412 of the switch actuator 41. As shown in FIG. 9A, when the switch actuator 41 is operated by a force (F) acting on the lower end portion 411 for driving the first driven projection 423, the slide frame 42 is move upwardly to establish electrical contact between the contact ends 321 of the conductive plates 32 and the contacts 340 of the first stationary contact member 34. As shown in FIG. 9B, when the switch actuator 41 is operated by a force (F') acting on the upper end portion 412 for driving the second driven projection 424, the slide frame 42 is move downwardly to establish electrical contact between the contact ends 321 of the conductive plates 32 and the contacts 350 of the second stationary contact member 35.

Referring once again to FIGS. 2, 5 and 6, the control unit includes a sleeve body 5, a normally closed control switch 54, a biasing member 6, and guiding means.

Figure 13:
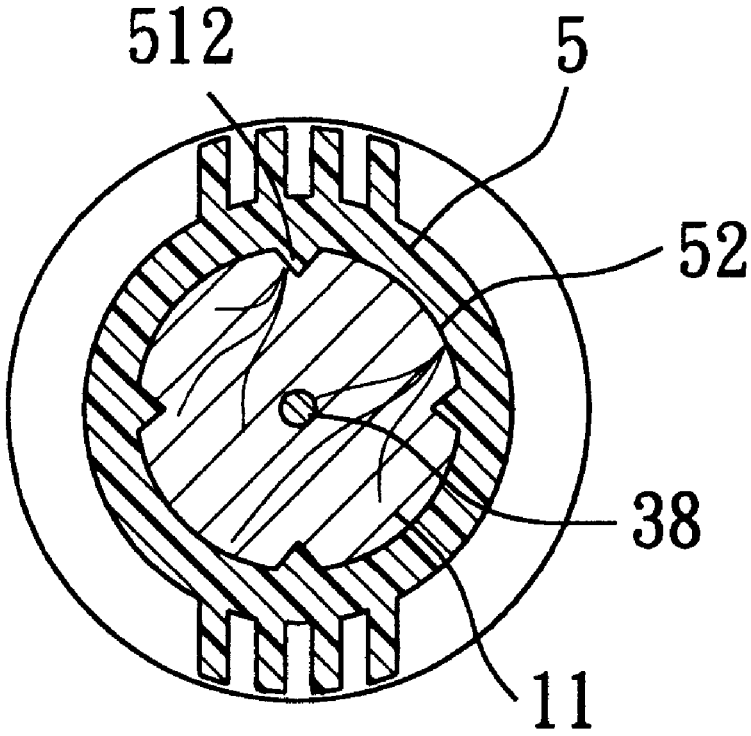
FIG. 13 is a schematic sectional view of FIG. 12 taken along line XIII—XIII.

The sleeve body 5 is disposed in the grip member 2 adjacent to the lower end 23. The sleeve body 5 defines a cork passage 52 with a wider lower portion 521, a narrower upper portion 523, and an intermediate shoulder portion 522 between the lower and upper portions 521, 523. The sleeve body 5 is movable vertically in the grip member 2 between a lower limit position, where the sleeve body 5 is stopped by the lower stop unit 216 as a result of engagement between the lower stop unit 216 and a stop ring 514 that extends radially and outwardly from a top end 513 of the sleeve body 5, and an upper limit position, where the stop ring 514 is stopped by the upper stop unit 212 (see FIG. 11). The auger 38 extends through the upper portion 523 and into the lower portion 521 of the cork passage 52 (see FIG. 5). As shown in FIG. 11, the lower portion 521 is adapted to permit extension of the bottleneck 12 therein, and the shoulder portion 522 is adapted to stop the bottleneck 12 from extending into the upper portion 523. The upper portion 523 of the cork passage 52 is formed with rib means, which includes a set of vertically extending ribs 512, for engaging the cork 11 on the auger 38 to resist rotation of the cork 11 with the auger 38 when the cork 11 extends into the upper portion 523 of the cork passage 52 (see FIG. 13). The control switch 54 is disposed in the grip member 2 above the sleeve body 5, and interconnects electrically one of the contacts 340 of the first stationary contact member 34 and the motor unit 36.

The biasing member 6 is disposed in the grip member 2 and biases the sleeve body 5 to the lower limit position. In this embodiment, the biasing member 6 is a coiled spring sleeved on the auger 38 and having opposite ends abutting respectively against a stop flange 211 on the inner surface of the grip member 2 and the stop ring 514 on the sleeve body 5.

The guiding means is provided on the grip member 2 and the sleeve body 5 for guiding vertical movement of the sleeve body 5 in the grip member 2 and for arresting rotation of the sleeve body 5 in the grip member 2. In this embodiment, the guiding means includes a plurality of vertically extending plates 214 formed on the inner surface of the grip member 2, each adjacent pair of the plates 214 defining a guiding groove 215, and a plurality of vertically extending guiding ribs 515 formed on the sleeve body 5 and engaging respectively the guiding grooves 215, as shown in FIG. 2.

Figure 12:
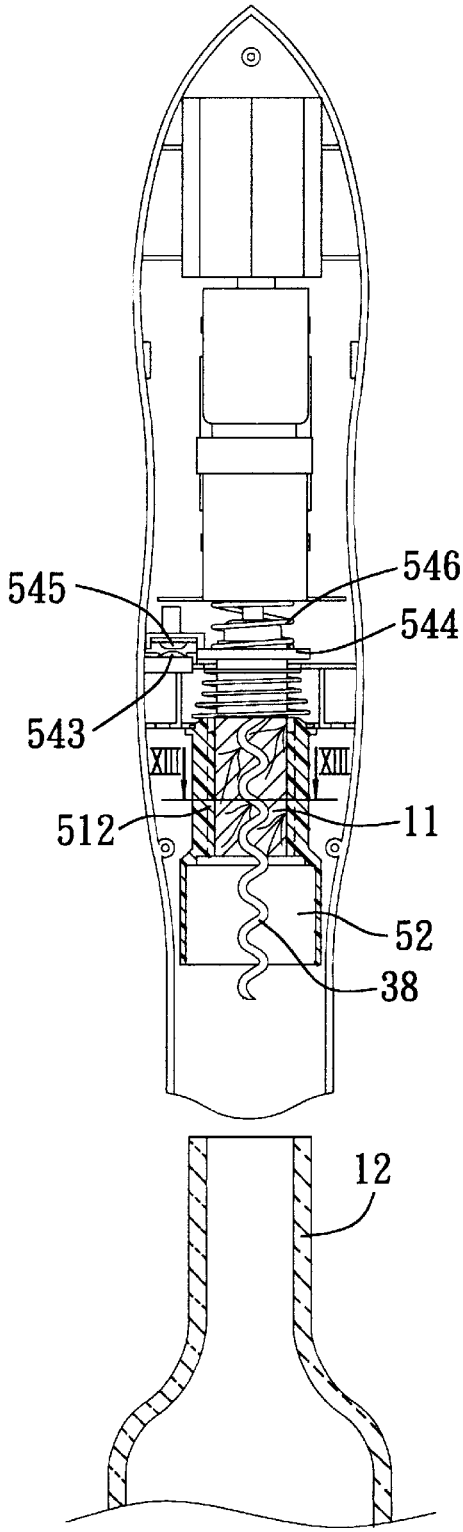
FIG. 12 is a schematic sectional view showing the preferred embodiment when a control switch is actuated by the cork that was unplugged from the bottleneck.

The control switch 54 is adapted to be actuated by the cork 11 in the cork passage 52 when the cork extends out of the upper portion 523 of the cork passage 52 as a result of rotation of the auger 38 in the positive direction (see FIG. 12). The control switch 54 interrupts electrical connection between the first stationary contact member 34 and the motor unit 36 when actuated by the cork 11 so as to disconnect the motor unit 36 from the battery set 33 of the electric power source 3 and cease further rotation of the auger 38 in the positive direction (see FIG. 10). In this embodiment, as shown in FIGS. 2 and 5, the control switch 54 includes a mounting seat 544, a biasing member 546, a movable electric contact 545, and a stationary electric contact 543. The mounting seat 544 is disposed in the grip member 2 above the sleeve body 5 and is movable in a vertical direction. The biasing member 546 is mounted in the grip member 2 and biases the mounting seat 544 downwardly toward the sleeve body 5. The movable electric contact 545 is mounted on the mounting seat 544 and is connected electrically to said one of the contacts 340 of the first stationary contact member 34 (see FIG. 6). The stationary electric contact 543 is mounted in the grip member 2, is aligned vertically with and disposed below the movable electric contact 545, and is connected electrically to the motor unit 36 (see FIG. 6). The movable electric contact 545 normally contacts the stationary electric contact 543 due to biasing action applied by the biasing member 546 on the mounting seat 544, as shown in FIGS. 5 and 11, and breaks contact with the stationary electric contact 543 when the mounting seat 544 is moved by the cork 11 in the cork passage 52 while the cork 11 extends out of the upper portion 523 of the cork passage 52 as a result of rotation of the auger 38 in the positive direction, as best shown in FIG. 12.

In actual operation, initially, the electric corkscrew is operated in a cork-screwing mode, wherein the lower end portion 411 of the switch actuator 4 is pressed to enable the contact plates 32 of the movable contact member 4 to contact electrically and respectively the contacts 340 of the first stationary contact member 34 such that electric power from the electric power source 3 is supplied to the motor unit 36 with the forward polarization to drive the auger 38 to rotate in the positive direction for screwing into the cork 11 that is to be unplugged. Then, the control switch 54 is actuated by the cork 11 in the cork passage 52 when the cork 11 extends out of the upper portion 523 of the cork passage 52 such that the electric power source 3 is disconnected from the motor unit 36 so as to cease further rotation of the auger 38 in the positive direction. Finally, the electric corkscrew is operated in a cork-releasing mode, wherein the upper end portion 412 of the switch actuator 4 is pressed to enable the contact plates 32 of the movable contact member 4 to contact electrically the contacts 350 of the second stationary contact member 35 such that electric power from the electric power source 3 is supplied to the motor unit 36 with the reverse polarization to drive the auger 38 to rotate in the negative direction for screwing out of the cork 11 that was unplugged from the bottleneck 12.

In view of the foregoing, due to the presence of the power switch and the control unit, the electric corkscrew of the present invention can be easily operated in the cork-screwing and cork-releasing modes, and can automatically cease supply of electric power to the motor unit when a cork has been unplugged from a the bottleneck.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. An electric corkscrew comprising:

a hollow grip member having an open lower end that is adapted to permit extension of a bottleneck plugged with a cork into said grip member;

an electric power source mounted in said grip member;

a motor unit mounted in said grip member;

an auger disposed rotatably in said grip member, coupled to said motor unit, extending to said lower end of said grip member, and adapted to screw into the cork in the bottleneck;

a power switch including first and second stationary contact members mounted fixedly in said grip member and coupled electrically to said motor unit, and a movable contact member mounted movably in said grip member and coupled electrically to said electric power source, said movable contact member being movable among one of a motor-deactivating position, a cork-screwing position and a cork-releasing position, wherein, when said movable contact member is disposed in the motor-deactivating position, said movable contact member does not contact any one of said first and second stationary contact members such that said motor unit is disconnected from said electric power source and does not drive rotation of said auger in said grip member, wherein, when said movable contact member is disposed in the cork-screwing position, said movable contact member contacts said first stationary contact member to enable supply of electric power from said electric power source to said motor unit with a forward polarization such that said motor unit drives said auger to rotate in a positive direction for screwing into the cork that is to be unplugged, and wherein, when said movable contact member is disposed in the cork-releasing position, said movable contact member contacts said second stationary contact member to enable supply of electric power from said electric power source to said motor unit with a reverse polarization such that said motor unit drives said auger to rotate in a negative direction for screwing out of the cork that was unplugged from the bottleneck; and a control unit including a sleeve body disposed in said grip member adjacent to said lower end, said sleeve body defining a cork passage with a wider lower portion, a narrower upper portion, and an intermediate shoulder portion between said lower and upper portions, said auger extending through said upper portion and into said lower portion of said cork passage, said lower portion being adapted to permit extension of the bottleneck therein, said shoulder portion being adapted to stop the bottleneck from extending into said upper portion, said upper portion being formed with rib means for engaging the cork on said auger to resist rotation of the cork with said auger when the cork extends into said upper portion of said cork passage, and a normally closed control switch disposed in said grip member above said sleeve body and interconnecting electrically said first stationary contact member and said motor unit, said control switch being adapted to be actuated by the cork in said cork passage when the cork extends out of said upper portion of said cork passage as a result of rotation of said auger in the positive direction, said control switch interrupting electrical connection between said first stationary contact member and said motor unit when actuated by the cork so as to disconnect said motor unit from said electric power source and cease further rotation of said auger in the positive direction.

2. The electric corkscrew as claimed in claim 1, wherein said grip member is formed with upper and lower stop units therein, said sleeve body being movable vertically in said grip member between a lower limit position, where said sleeve body is stopped by said lower stop unit, and an upper limit position, where said sleeve body is stopped by said upper stop unit.

3. The electric corkscrew as claimed in claim 2, wherein said control unit further includes a biasing member disposed in said grip member and biasing said sleeve body to the lower limit position.

4. The electric corkscrew as claimed in claim 3, wherein said control unit further includes guide means provided on said grip member and said sleeve body for guiding vertical movement of said sleeve body in said grip member and for arresting rotation of said sleeve body in said grip member.

5. The electric corkscrew as claimed in claim 1, wherein said control switch includes:

a mounting seat disposed in said grip member above said sleeve body and movable in a vertical direction;

a biasing member mounted in said grip member and biasing said mounting seat downwardly toward said sleeve body;

a movable electric contact mounted on said mounting seat and connected electrically to one of said first stationary contact member and said motor unit; and a stationary electric contact mounted in said grip member, aligned vertically with and disposed below said movable electric contact, and connected electrically to the other one of said first stationary contact member and said motor unit;

wherein said movable electric contact normally contacts said stationary electric contact due to biasing action applied by said biasing member on said mounting seat, and breaks contact with said stationary electric contact when said mounting seat is moved by the cork in said cork passage while the cork extends out of said upper portion of said cork passage as a result of rotation of said auger in the positive direction.

6. The electric corkscrew as claimed in claim 1, wherein each of said first and second stationary contact members includes a pair of contacts, said movable contact member including a spring-loaded slide frame mounted movably in said grip member and a pair of conductive plates mounted on said slide frame and coupled electrically to said electric power source, each of said conductive plates having a pair of contact ends, each of said contact ends of each of said conductive plates being disposed adjacent to a respective one of said contacts of said first and second stationary contact members.

7. The electric corkscrew as claimed in claim 6, wherein said grip member is formed with a switch-mounting hole, said power switch further including a switch actuator mounted on said grip member in said switch-mounting hole, said switch actuator having opposite end portions, and an intermediate portion connected to said end portions and pivotally connected to said grip member, each of said end portions being formed with a drive projection, said slide frame being formed with first and second driven projections, each of which is to be driven by said drive projection on a respective one of said end portions of said switch actuator, wherein, when said switch actuator is operated for driving said first driven projection, said slide frame is moved to establish electrical contact between said conductive plates and said contacts of said first stationary contact member, and wherein, when said switch actuator is operated for driving said second driven projection, said slide frame is moved to establish electrical contact between said conductive plates and said contacts of said second stationary contact member.

8. The electric corkscrew as claimed in claim 1, wherein said electric power source includes a rechargeable battery set, and charging means for charging said battery set.

* * * * *